US005664996A

United States Patent [19]

Wang et al.

[11] Patent Number: 5,664,996

[45] Date of Patent: Sep. 9, 1997

[54] MULTIPLE BLADE WINDOW FAN

[75] Inventors: Jui-Shang Wang, Taipei, Taiwan; Rodney Jané, Westboro; John Longan, Natick, both of Mass.; John M. Staton, Briston, Conn.

[73] Assignee: Duracraft Corporation, Southborough, Mass.

[21] Appl. No.: 395,721

[22] Filed: Feb. 28, 1995

[51] Int. Cl.[6] ..... F24F 7/013

[52] U.S. Cl. ..... 454/210; 454/208

[58] Field of Search ..... 454/200, 205, 454/208, 210, 338

[56] References Cited

U.S. PATENT DOCUMENTS 4,773,310 9/1988 Corwin ..... 454/210 X 5,334,091 8/1994 Shih-Chin ..... 454/210

*Primary Examiner*—Harold Joyce

*Attorney, Agent, or Firm*—John E. Toupal; Harold G. Jarcho

[57] ABSTRACT

A portable window fan including a housing having a bottom wall for mounting on a sill of a window with an open sash, a top wall for engaging the open sash, a rear wall defining a plurality of inlet openings, and a front wall defining three substantially aligned discharge openings spaced apart in a given direction substantially parallel to the top wall. Also included are three fan blades mounted within the housing, each fan blade arranged to produce air flow through a different one of the discharge openings; an electrical drive coupled to the fan blades and operative to induce rotation thereof; and a grill mechanism covering the discharge openings.

10 Claims, 3 Drawing Sheets

MULTIPLE BLADE WINDOW FAN

BACKGROUND OF THE INVENTION

This invention relates generally to a portable electric fan and, more particularly, to a portable electric window fan.

Portable electric fans are used extensively to reduce personal discomfort caused by excessive temperatures. Some portable electric fans are designed specifically for mounting in open windows of inhabited enclosures and typically operable to either exhaust air from the enclosure or direct outside air thereinto. Although generally quite efficient in establishing desirable air circulation between inside and outside of a particular enclosure, prior window fans have failed to provide fully satisfactory air flow selectivity because of positional mounting limitations. For example, conventional window fans do not provide the variety of air flow distribution patterns furnished by portable floor or table fans that can function in a wider variety of positions.

The object of this invention, therefore, is to provide an improved, more versatile portable window fan.

SUMMARY OF THE INVENTION

The invention is a portable window fan including a housing having a bottom wall for mounting on a sill of a window with an open sash, a top wall for engaging the open sash, a rear wall defining a plurality of inlet openings, and a front wall defining three substantially aligned discharge openings spaced apart in a given direction substantially parallel to the top wall. Also included are three fan blades mounted within the housing, each fan blade arranged to produce air flow through a different one of the discharge openings; an electrical drive coupled to the fan blades and operative to induce rotation thereof; and a grill mechanism covering the discharge openings. Air flow pattern versatility of the fan is significantly improved by the three fan blades.

According to certain features of the invention, the grill mechanism includes three grill members, each covering a different one of the discharge openings and having vanes for directing air flow in a predetermined direction, and each grill member is movable relative to the housing so as to permit selective adjustment of the predetermined direction. These features significantly enhance air flow direction selectivity of the fan.

According to another feature of the invention, the fan includes walls retained by the housing and movable relative thereto in the given direction. The walls facilitate tight mounting of the fan in a window opening.

According to additional features of the invention, the electrical drive includes an electric motor operatively coupled to each fan blade, and the fan includes a control circuit having switch means for selectively connecting the electric motors to a source of electrical energy. These features permit selective independent control of the multiple fan blades.

According to still other features of the invention, the switch means is selectively activatable into first, second and third operating conditions, the first operating condition providing energization of only one of the electric motors, the second operating condition providing energization of only two of the electric motors, and the third operating condition providing energization of all three electric motors. Selective operation of the switch means provides a variety of air flow patterns.

According to yet other features of the invention, the fan blades include a first fan blade straddled by second and third fan blades, the first operating condition provides energization of the electric motor operatively coupled to the first fan blade, and the second operating condition provides energization of the electric motors operatively coupled to the second and third fan blades. These features establish for the different operating conditions, particularly desirable air flow patterns.

According to a further feature of the invention, the switch means is a multiple-position electrical switch. Establishment of multiple operating conditions with a single electrical switch reduces cost of the flow.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
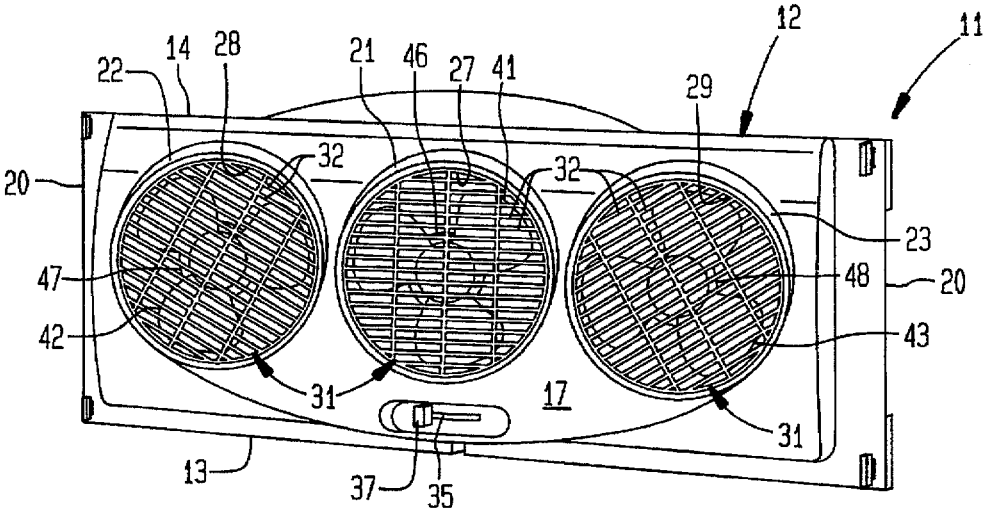
FIG. 1 is a perspective front view of a portable fan according to the invention.
Figure 3:
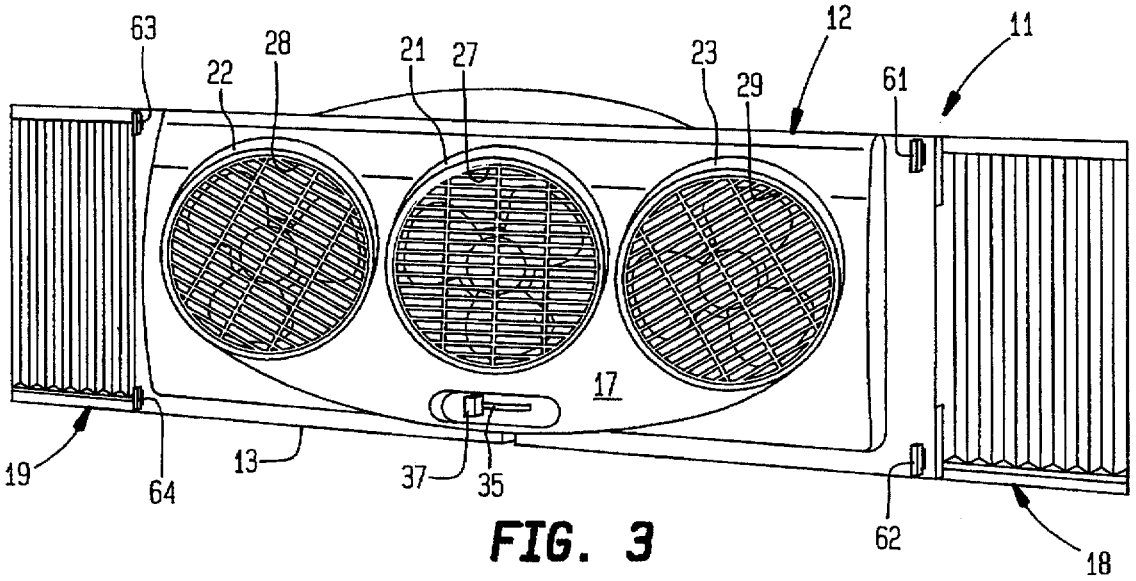
FIG. 3 is a perspective front view of the fan shown in FIGS. 1 and 2 with movable end walls extended.

A portable electric fan 11 includes a housing 12 having a bottom wall 13 suitable for mounting on a sill of a window (not shown) with an open sash and a top wall 14 arranged for engaging a bottom edge of the sash. Also forming the housing 12 are a rear wall 16 and a front wall 17 both extending between the bottom wall 13 and the top wall 14. Retained within the housing 12 and expandable from opposite sidewalls 20 thereof are movable wing walls 18, 19 of a type disclosed in U.S. Pat. No. 5,382,136.

Three cylindrical projections 21–23 extend outwardly from the front wall 17 and establish discharge regions spaced apart and transversely aligned in a given direction parallel to the top wall 14. Defined by the projections 21–23, respectively, are a first discharge opening 27 and straddling second and third discharge openings 28, 29. Each of the projections 21–23 is covered by a circular grill 31 having vanes 32 for directing airflow in a predetermined transverse direction out of the discharge openings 27–29. The grills 31 are mounted for rotation on the cylindrical projections 21–23 so as to permit selective adjustment of the predetermined direction in which air is discharged through the discharge openings 27–29. Also defined by the front wall 17 is a slot 35 accommodating an actuator rod 36 having opposite ends connected, respectively, to an operating knob 37 and a multiple-position switch 38 (FIG. 4) of a control circuit 39 disposed within the housing 12.

Figure 2:
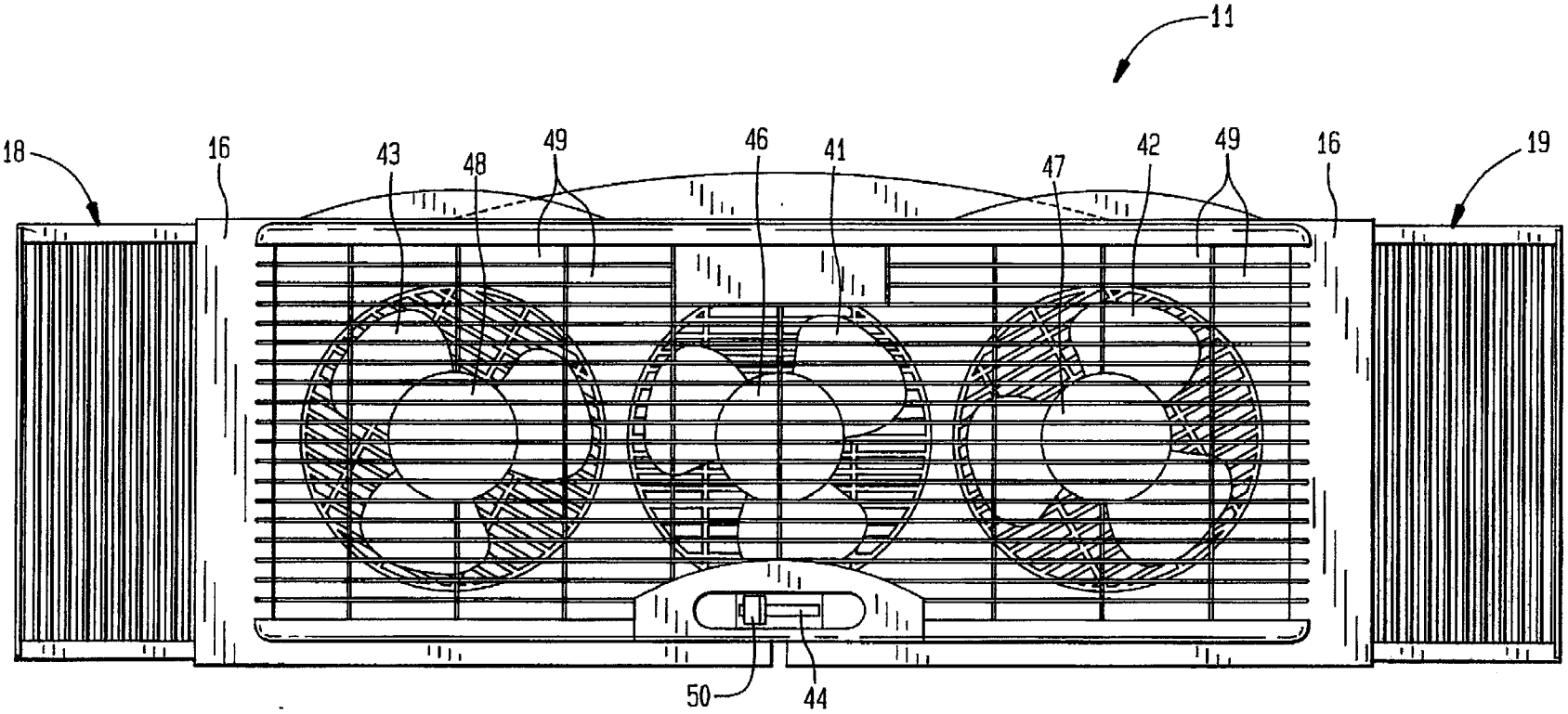
FIG. 2 is a rear view of the portable fan shown in FIG. 1.

Rotatably mounted within the housing 12 and aligned with the discharge openings 27–29, respectively, are a first fan blade 41 and second and third fan blades 42, 43 straddling the first blade 41. The fan blades 41–43 are operatively coupled, respectively, to individual electrical motors 46–48 also mounted within the housing 12. Aligned with the discharge openings 27–29 and the fan blades 41–43 are a plurality of inlet openings 49 defined by the rear wall 16 as shown in FIG. 2.

Figure 4:
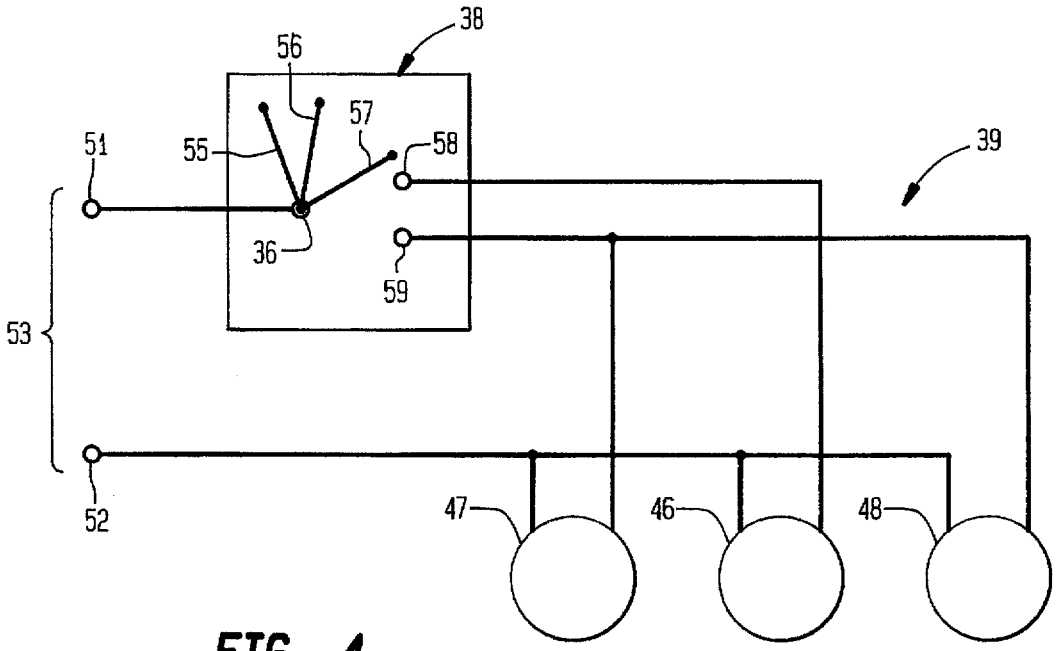
FIG. 4 is a schematic diagram of a control circuit for the fan shown in FIGS. 1–3.

Interconnecting the multiple-position switch 38, the electric motors 46–48 and wires 51, 52 of a power supply 53 is the control circuit 39 depicted in FIG. 4. The switch 38 has three contact arms 55, 56, 57 with inner ends attached for movement with the actuator shaft 36. Opposite ends of the contact arms 55–57 sequentially engage a pair of contacts 58, 59 in response to rotation of the shaft 36. The control circuit 39 connects the electric motor 47 between the supply line 52 and the switch contact 59, the electric motor 46 between the supply line 52 and the switch contact 58 and the electric motor 48 between the supply line 52 and the switch contact 59.

Figure 5:
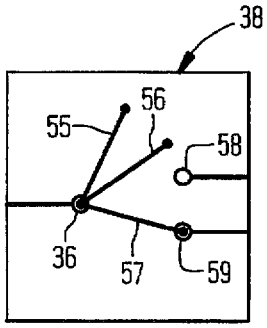
FIGS. 5–7 are schematic views illustrating different operating positions of an electrical switch of the control circuit shown in FIG. 4.
Figure 6:
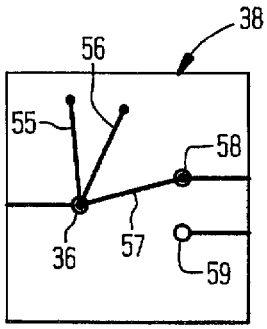
Figure 7:
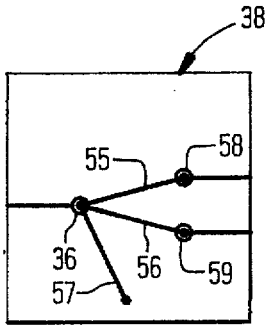

In an off position of the switch 38 illustrated in FIG. 4, the contact arms 55–57 are separated from the switch contacts 58, 59 and the electric motors 46–48 are deenergized to deactivate the fan blades 41–43. Rotation of the switch 38 into one on position (FIG. 6) establishes a first operating condition in which the contact arm 57 engages the switch contact 58 providing energization of only the first electric motor 46 and activation of the first fan blade 41 to produce air flow through only the first discharge opening 27. In another on position (FIG. 5) of the switch 38, the contact arm 57 engages the switch contact 59 to establish a second operating condition in which both of the electric motors 47, 48 are energized to activate the fan blades 42, 43 and produce air flow through both of the discharge openings 28, 29. Finally, in a third on position (FIG. 7) of the switch 38, the contact arm 55 engages the switch contact 58 and the contact arm 56 engages the switch contact 59 to establish a third operating condition in which all of the electric motors 46–48 are energized to activate all three fan blades 41–43 and produce air flow through all three discharge openings 27–29.

Prior to use, the bottom wall 13 of the fan 11 is mounted on a sill of an open window (not shown), and a lower edge of a sash therein is moved into engagement with the top wall 14. The movable walls 18, 19 then are expanded into contact with side edges of the window and latched in position with latch mechanisms 61–64 of the type described in the above noted U.S. Pat. No. 5,382,136. The electric switch 38 then can be actuated in the manner described above to provide selective activation of either the middle fan blade 41 alone, the straddling second and third fan blades 42, 43 or all three of the fan blades 41–43 depending upon the rate of air flow desired. In addition, the distribution pattern of the air flow from the discharge openings 27–29 can be selected by rotating each of the grills 31–33 into a desired rotational position on, respectively, the projections 21–23.

Obviously, many modifications and variations of the present invention are possible in light of the above teachings. It is to be understood, therefore, that the invention can be practiced otherwise than as specifically described.

What is claimed is:

1. A portable window fan comprising:

housing means comprising a bottom wall for mounting on a sill of a window with an open sash, a top wall for engaging the open sash, a rear wall defining a plurality of inlet openings, and a front wall defining three discharge regions substantially aligned with said inlet openings and spaced apart in a given direction substantially parallel to said top wall;

three fan blades mounted within said housing means, each fan blade arranged to produce air flow through a different one of said discharge regions;

electrical drive means coupled to said fan blades and operative to induce rotation thereof, said electrical drive means comprising an electric motor operatively coupled to each said fan blade;

grill means covering said discharge regions; and control circuit means including switch means for connecting said electric motors to a source of electrical energy, said switch means being selectively activatable into first, second and third operating conditions; said first operating condition providing energization of only one of said electric motors, said second operating condition providing energization of only two of said electric motors, and said third operating condition providing energization of all three said electric motors.

2. A fan according to claim 1 wherein said grill means comprises three grill members, each covering a different one of said discharge regions.

3. A fan according to claim 2 wherein each said grill member defines vanes for directing air flow in a predetermined direction out of said discharge region.

4. A fan according to claim 3 wherein each said grill member is freely adjustable relative to said housing so as to permit selective adjustment of said predetermined direction.

5. A fan according to claim 4 wherein each said fan blade is substantially aligned with a different one of said discharge regions.

6. A fan according to claim 5 including movable wall means retained by said housing means and movable relative thereto in said given direction.

7. A fan according to claim 1 wherein said fan blades include a first said fan blade straddled by second and third said fan blades, and said first operating condition provides energization of said electric motor operatively coupled to said first fan blade.

8. A fan according to claim 7 wherein said second operating condition provides energization of said electric motors operatively coupled to said second and third fan blades.

9. A fan according to claim 8 wherein said switch means is a multiple-position electrical switch.

10. A fan according to claim 1 wherein said fan blades include a first said fan blade straddled by second and third said fan blades, and said second operating condition provides energization of said electric motors coupled to said second and third fan blades.

* * * * *